United States Patent [19]

Ruff

[11] Patent Number: 4,493,148

[45] Date of Patent: Jan. 15, 1985

[54] CORRUGATED CARTON CUTTER

[76] Inventor: Stanley L. Ruff, 9 Arbor Dr., New Rochelle, N.Y. 10804

[21] Appl. No.: 538,157

[22] Filed: Oct. 3, 1983

[51] Int. Cl.[3] ..... B26B 29/02

[52] U.S. Cl. ..... 30/2; 30/293

[58] Field of Search ..... 30/2, 286, 294, 293

[56] References Cited

U.S. PATENT DOCUMENTS

| | | | |
|---|---|---|---|
| 1,908,851 | 5/1933 | Laferer | 30/2 |
| 2,291,075 | 7/1942 | Hanson | 30/2 |
| 2,644,230 | 7/1953 | Anderson | 30/2 X |
| 2,682,104 | 6/1954 | Arnold | 30/2 |
| 3,037,278 | 6/1962 | Genetti | 30/293 X |
| 3,195,231 | 7/1965 | Lightburn | 30/2 |
| 3,430,339 | 3/1969 | Hobson | 30/2 |
| 3,641,667 | 2/1972 | Leopoldi | 30/2 |
| 3,999,290 | 12/1976 | Wood | 30/2 |
| 4,012,836 | 3/1977 | Baer | 30/2 |

*Primary Examiner*—Jimmy C. Peters

*Attorney, Agent, or Firm*—Kirschstein, Kirschstein, Ottinger & Israel

[57] ABSTRACT

A cutting tool for cutting corrugated shipping cartons open includes a cutting blade and a holding arrangement for the cutting blade. The holding arrangement includes a confining member and a support member on which the cutting blade is held in its active position by being accommodated in a recess and having a stationary finger holding the blade and which is mounted on the confining member for movement between first and second positions displaced 90° relative to each other. A cover for the cutting blade is mounted on the confining member for pivoting between its closed and open positions. The holding arrangement includes a contact surface which engages the edge region of the respective carton at the side wall thereof, and a distancing surface which engages the top wall of the carton during the cutting operation with the cover in its open position and with the support member in its first position to determine the distance of the cutting blade from the top wall. In its closed position, the cover either prevents access to the blade when the support member is in its first position, or maintains the support member in its second position in which the contact surface and an additional contact surface provided on the cover in alignment with the contact surface engage the respective carton at any region during the cutting operation.

27 Claims, 10 Drawing Figures

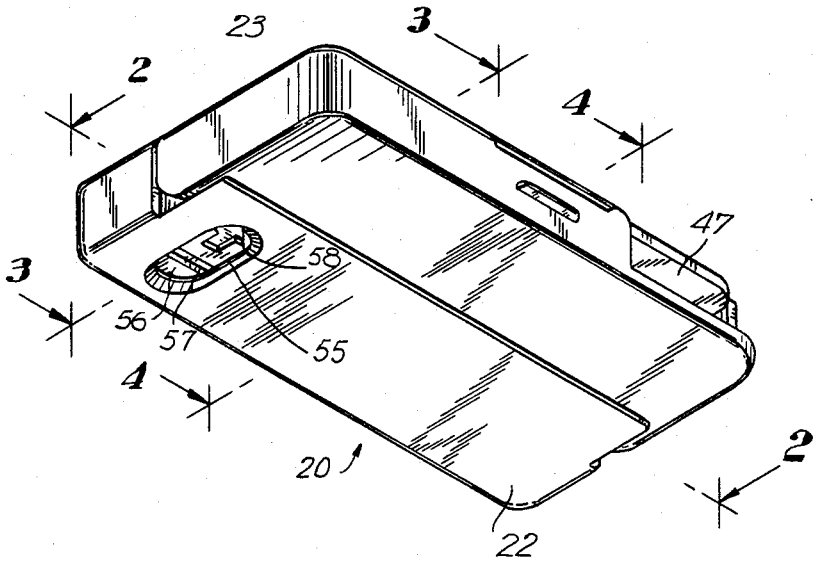
FIG. 1
FIG. 2
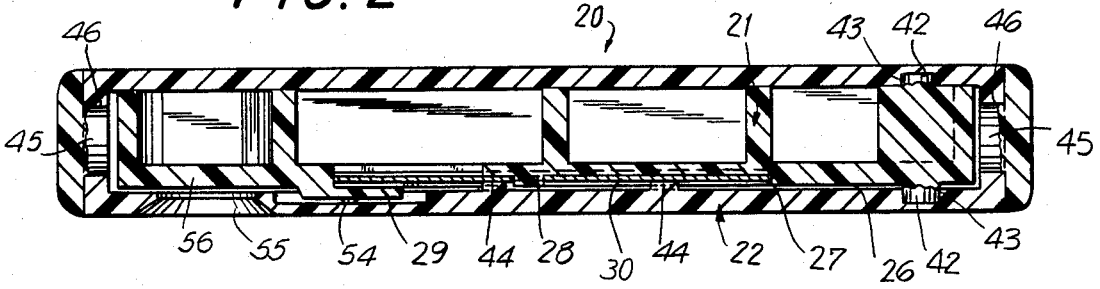
FIG. 3
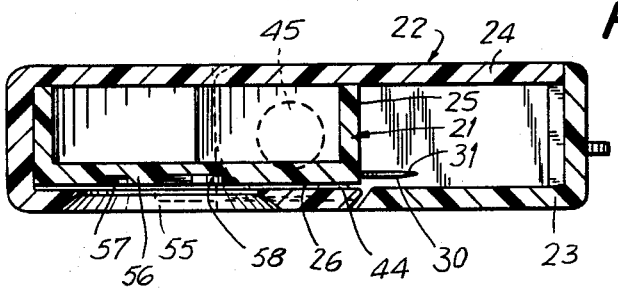
FIG. 4
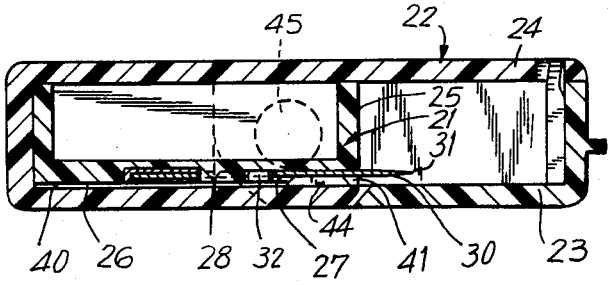

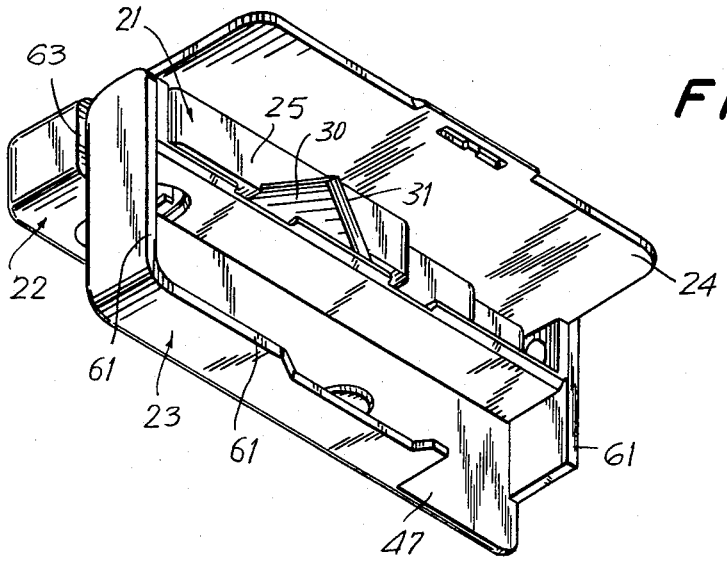
FIG. 5
FIG. 6
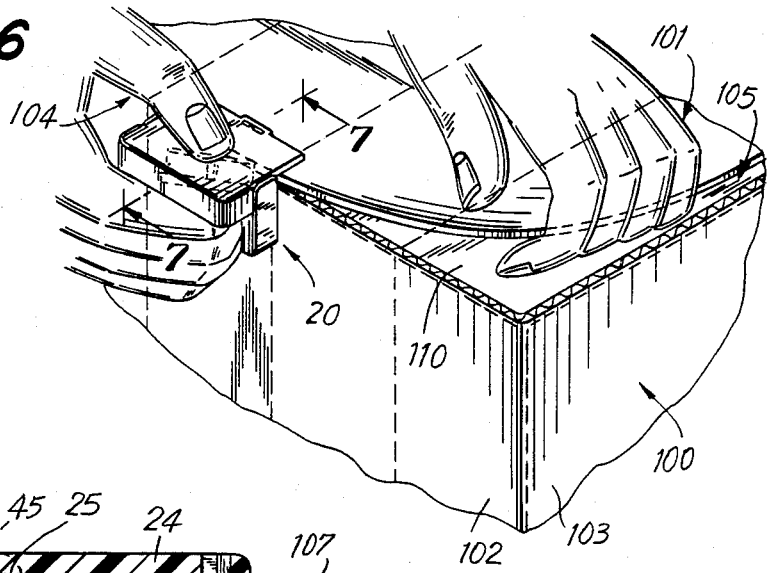
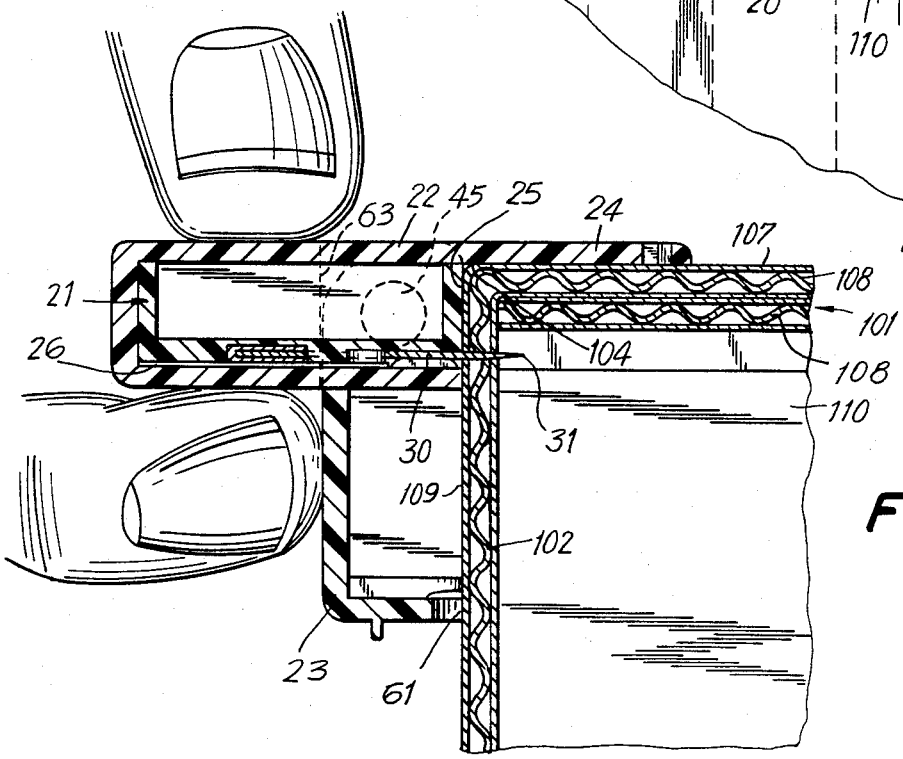
FIG. 7

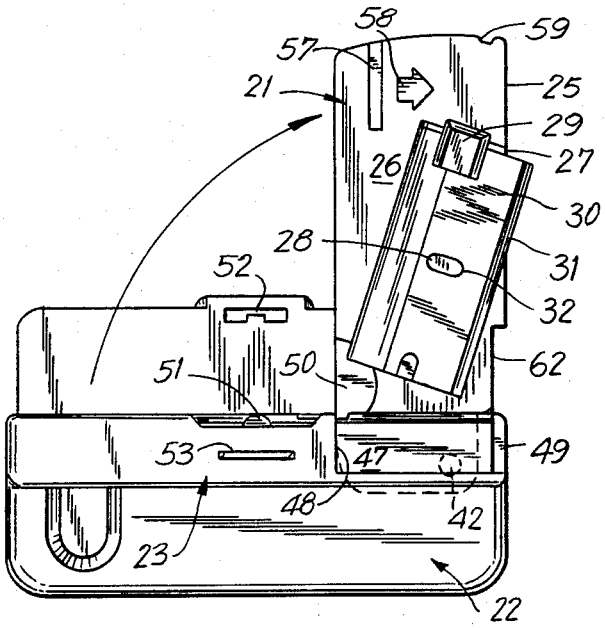
FIG. 8
FIG. 9
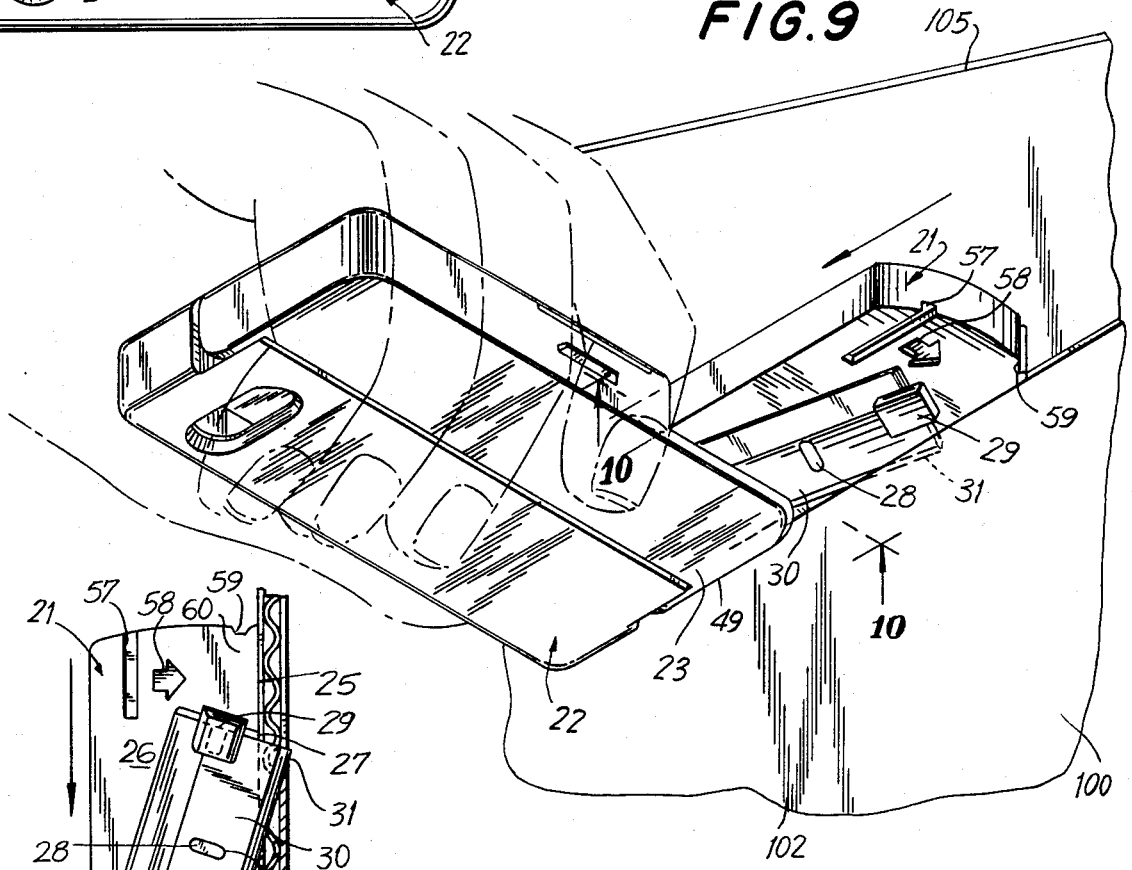
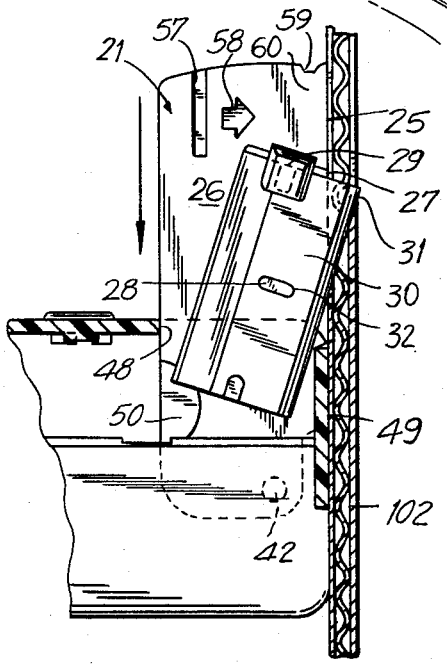
FIG. 10

CORRUGATED CARTON CUTTER

BACKGROUND OF THE INVENTION

The present invention relates to utility knives in general, and more particularly to a utility knife or cutter that is especially constructed and suited for cutting corrugated boxes open either along their edges, or at any other regions thereof, without damaging the contents of such boxes.

Utility knives and similar tools are already known in a variety of constructions. In most instances, such a utility knife utilizes a cutting blade which is constituted by or has a configuration resembling that of a razor blade. Yet, generally speaking, the cutting blade may have any shape which is best suited for the performance of the cutting action. The cutting blade is then immovably mounted in a holding arrangement or holder in such a manner that at least one cutting edge of the cutting blade is exposed so that it can be inserted into the object to be cut and an incision can be made by moving the holder relative to the object in such a way that the cutting edge of the cutting blade is in front.

Utility knives of this construction can be used, for instance, for cutting boxes, especially of corrugated board, open to gain access to the contents thereof. This cutting operation is usually to be performed as close to the respective edge of the box as possible to assure that, after the cutting operation is completed, for instance, by cutting along at least three of the top edges of the box, the remainder of the box will not fall apart and spill the contents thereof, while convenient removal of the contents, without undue manipulation, is assured after the top portion of the box has been moved into its open position. However, it is often also desirable to cut open such boxes at regions other than along the edges, and even then it is desirable that the cutting be done without damage to the box contents.

An application in which such utility knives are frequently used is in opening boxes in supermarkets and similar commercial establishments. In this environment, the box to be cut open often is a shipping carton whose contents consists of a multitude of smaller cartons each of which contains the item to be sold, be it a quantity of cereal, or another foodstuff, or of other flowable material, or another item or a plurality of items contained in a package. Regardless of the item, items or the contents of the packages contained in the box, it is undesirable from the viewpoint of the manufacturer of the item or contents and, in most instances, even from the viewpoint of the store owner, when the smaller carton or package is damaged or destroyed during the cutting operation, be it because the contents of such smaller box may spill if the smaller box is damaged and thus require a cleaning operation which detracts from more productive work of the store employee, or because the appearance of the smaller box on display is less attractive and hence less likely to entice the potential customer into purchasing the item contained in the box. The incentive to avoid damage to the smaller packages is especially great for the manufacturers, many if not all of whom have established a policy of giving credit to their customers for damaged packages. This credit may take the form of full refund for any returned damaged packages, in which case the customer has no incentive to keep the number of the damaged packages to a minimum. To make the customer interested in minimizing the number of damaged packages, many manufacturers give a credit in the form of a certain percentage of the items delivered, so that any damage in excess of this flat rate will be the responsibility of the store owner, and any lowering of the damage below the flat rate will inure to the benefit of the store owner. This, however, does not assure that the person doing the actual cutting will be careful not to damage the smaller packages contained in the large carton or box while cutting the latter open, since such a person has only a minimum stake in the outcome of the cutting operation and, in many instances, is not very skilled to begin with.

In view of this situation, attempts have already been made to develop a utility knife especially suited for the above discussed purpose of cutting large boxes containing a plurality of smaller packages open with minimum, if any, damage to the packages. The results of these attempts may be seen, for instance, in the U.S. Pat. Nos. 1,527,220; 1,908,851; 2,550,346; 2,682,104 and 3,430,339. However, these known solutions possess certain disadvantages, one of which is that such utility knives are rather unwieldy and are of multi-part construction. Thus, for instance, in the conventional constructions, the replacement of a worn-out cutting blade requires the manipulation of a great many separate parts, and is a very cumbersome and time-consuming operation, resulting in a substantial amount of wasted time. The manipulation of a great number of separate parts increases the likelihood that the blade replacement will not be done at the proper time, and the individual parts are more prone to being misplaced. Moreover, the shapes of such conventional utility knives or implements are such that they cannot be simply put into a pocket, which results in a situation where they are often mislaid or even lost, resulting in additional loss of time and money. Moreover, the cutting edges of the cutting blades of these conventional arrangements are not altogether reliably guided at all times during the cutting operation, thereby sometimes resulting in a jagged cut in the box, especially when the level of carefulness is diminished. Apparently for these reasons, these conventional constructions, as advantageous as they may seem to be from the operational point of view, did not achieve wide acceptance in the field, and the cutting operation is usually performed by utility knives of other constructions which do not have the above drawbacks but which are more likely to cause damage to the contents of the box being cut open because they are not designed for the specific purpose of cutting such corrugated boxes open.

A corrugated carton cutter which avoids at least some of the aforementioned disadvantages of the prior art has recently been proposed in a pending U.S. patent application Ser. No. 460,946, filed Jan. 24, 1983, entitled "Corrugated Carton Cutter", in the names of Stanley Ruff, et al. Although generally satisfactory for its intended purpose of cutting boxes open along their edges without damaging the contents of such boxes, said proposed cutter is not altogether versatile in the sense that it cannot be used for cutting the boxes open at regions other than along their edges. So, for instance, if it is desired to cut along a diagonal or other line, whether straight or curved, on a box surface, said proposed cutter could not be used, because it is designed to cut along the edge regions of the box. The capability of performing a cutting operation at other than the edge regions of the box is highly desirable in many applications, particularly in a supermarket, where the shipping carton may be designed to be opened along a box surface away from its edge regions, typically for the purpose of converting the shipping carton into a point-of-purchase display box.

SUMMARY OF THE INVENTION

Accordingly, it is a general object of the present invention to avoid the disadvantages of the prior art.

More particularly, it is an object of the present invention to provide an implement for cutting boxes open, which implement does not possess the disadvantages of the conventional cutting implements of this type.

It is yet another object of the present invention so to construct the arrangement of the type here under consideration as to avoid damage to the packages contained in a box during the use of the arrangement for cutting the box open.

Yet another object of the present invention is to so design the above arrangement as to be safe to use and capable of being carried in a pocket without damaging the same or injuring the user.

A concomitant object of the present invention is to develop a utility cutting tool which is simple in construction, inexpensive to manufacture, easy to use, and reliable in operation nevertheless.

An additional object of the present invention is to devise a cutting implement capable of cutting corrugated boxes open either along their edges, or at any other regions, at the option of the user of the implement, with similarly advantageous results.

In pursuance of these objects and others which will become apparent hereafer, one feature of the present invention resides in an arrangement for holding a cutting blade having at least one cutting edge, particularly for use as a utility knife for opening filled boxes, especially of corrugated board which include associated adjacent box surfaces that meet at respective edges, comprising a support member for the blade having a major surface and a contact surface substantially normal to said major surface and operative for contacting one of the associated adjacent surfaces of the box during the cutting operation; means for dismountably holding the blade on the major surface in an active position in which the cutting edge of the blade is at least partially situated beyond the contact surface of the holding member to penetrate into the respective box next to the contact surface during the cutting operation; a confining member having a distancing surface substantially parallel to and spaced a predetermined distance from the blade; means for mounting the support member on the confining member for movement relative thereto between a first position in which said confining member confines the blade between itself and the major surface and the distancing surface extends beyond the contact surface to engage the other of the associated adjacent surfaces of the box during the cutting operation and thus to keep the cutting blade at the predetermined distance from the other adjacent surface, and a second position in which the support member extends beyond the distancing surface, and the blade is accessible; and a cover for the cutting edge of the blade mounted on the confining member for displacement between an open position in which the cutting edge is exposed both in the first and second position of the support member, and a closed position in which the cutting edge is covered when the support member is in the first position, and exposed beyond the cover when the support member is in the second position thereof, the cover including means for confining the blade between itself and the major surface, and means for keeping the support member in the second position thereof, in the closed position of the cover.

A particular advantage of the construction described so far is that it is exceptionally easy to gain access to the cutting blade mounted in the holding arrangement, for instance, for the purpose of replacing or reorienting the cutting blade, by simply moving the holding and confining members relative to one another out of the first position into the second position after first opening the cover. Yet, due to the confining action of the confining member in the first position, combined with the holding action of the holding means, the cutting blade is firmly held in position in the holding arrangement and cannot move relative thereto even as substantial forces are applied to the cutting blade or to the cutting edge thereof during its penetration into the material being cut.

Moreover, since the cover keeps the support member firmly in place and confines the blade between itself and the major surface of the support member in the second position, in which the blade is situated out of the region of the distancing surface, the arrangement of the present invention can be used in this condition for cutting at any region of the corrugated box or carton, without the limitations otherwise presented by the presence of the distancing surface next to but spaced from the blade. It will further be appreciated that, so long as the contact and distancing surfaces are kept in contact with the associated adjacent surfaces of the box to be opened during the cutting operation in the first position of the support member, they will maintain the cutting blade in the desired position relative to the edge at which the two adjacent surfaces of the box meet, thus assuring the desired degree of penetration of the cutting blade into the box, and distancing of the blade from the surface of the box which is parallel thereto by an amount sufficient for the cutting blade to avoid the material of the wall of the box which extends parallel to the blade. Furthermore, due to the presence of the cover, it is possible to transport the holding arrangement from one location to another with the support member in its first position and the cover closed without danger of damage or injury, for instance, in a pocket of an apron or another garment worn by the user of the holding arrangement, with the cutting blade mounted in the holding arrangement in its cutting position.

Advantageously, the holding means is so arranged relative to the major surface of the support member that the cutting edge of the blade extends at an acute angle relative to the contact surface of the support member in the active position of the blade. A particular advantage of this feature is that the cutting edge is in a position during the cutting operation in which the cutting action encounters the least amount of resistance, especially since the material being cut cannot accumulate in front of the cutting blade.

A particularly simple and otherwise advantageous construction of the holding means is obtained when it includes means for defining a recesss for accommodating a portion of the blade at the major surface. However, when the cutting blade has at least one opening therein, it is advantageous when the holding means includes, instead or in addition to the above defining means, at least one projection on the support member at the major surface thereof, this projection extending into the opening of the blade when the latter is juxtaposed with the major surface, that is, especially in the aforementioned active position thereof.

According to another aspect of the present invention, the guiding means includes means for bounding a channel in the confining member, this channel fittingly receiving at least a predominant part of the support member in the first position and guiding the support member during the movement thereof relative to the confining member between the first and second positions. It is particularly advantageous in this context when the confining member embraces the support member, that is, when it surrounds the latter on all sides with the exception of a slot which connects the channel of the confining member with the exterior of the latter and receives a part of the blade during and upon assembly of the support and confining members with one another. To prevent the support and confining members from inadvertently moving out of the first position thereof relative to one another, it is further advantageous to provide retaining means on such members, such retaining means keeping the members in their first position. A particularly simple embodiment of this aspect is obtained when the retaining means includes at least one elastic projection on one of the members, which engages the other of the members in the first position of the members relative to each other.

To assure proper positioning of the blade and desired depth of penetration into the box, it is particularly advantageous when the predetermined distance amounts at least to substantially twice the thickness of the material of the box, since then the cutting blade will clear the wall parallel thereto even at a region of overlap of two portions of flaps of the box. On the other hand, the holding means so holds the cutting blade in the active cutting position thereof that the cutting edge of the blade extends beyond the contact surface of the holding arrangement to an extent amounting at least to once the thickness of the material of the box. However, the cutting blade may advantageously extend beyond the contact surface to at least twice the thickness of the material of the box so as to be able to cut through regions of the box walls at which the material is present in double thickness. Yet, even under these circumstances, the packages accommodated in the interior of the box will not be damaged when the arrangement is used with the support member in its first position since, due to the presence of the distancing surface, the cutting blade cannot get as close to the internal package as to damage the same.

According to a further advantageous concept of the present invention, the holding arrangement further comprises a cover for the cutting edge of the blade, and means for mounting the cover on the holding arrangement, wherein particularly good results both to the simplicity of the operation and the likelihood that the user will close the cover after each use are obtained when the mounting means is constituted by at least one hinge which mounts the cover on the support member for pivoting relative thereto.

In a currently preferred construction of the holding arrangement incorporating this expedient, the confining member has an abutment portion or surface which forms an abutment for the cover in the open position of the latter, while not interfering with the displacement of the cover toward and into its closed position. The abutment portion is advantageously so positioned that an engagement surface of the cover is situated substantially in the same plane as the contact surface of the support member in the open position of the cover, so that the engagement of the engagement surface of the cover with the box being cut provides additional guidance for the holding arrangement on the box and additional safeguard against too deep a penetration of the cutting blade into the interior of the box.

An important consideration in the design of the holding arrangement according to the present invention is to assure that the cover will not accidentally open and thus expose the blade with a danger of possible damage to the garment worn by, or injury to, the user. To this end, the holding arrangement is equipped with means for releasably arresting the cover in the closed position thereof. Such arresting means advantageously includes at least one elastic projection on one, and at least one receiving recess for the projection in the other, of the confining member and cover, the receiving recess receiving the projection in the closed position, and in the closed position only, of the cover.

Since it is desired that the utility knife constituted by the holding arrangement of the present invention and the cutting blade mounted thereon be usable for cutting boxes not only in the aforementioned first positon of the support member relative to the confining member, but also in the second position of the support member, it is advantageous when the cover had a cutout for passage of the support member therethrough in the closed position of the cover and the second position of the support member. This cutout is advantageously delimited by at least one delimiting surface constituting the aforementioned keeping means that keeps the support member in its second position so long as the cover is closed. In this respect, it is further advantageous when the cover has an additional contact surface aligned with and constituting an extension of the contact surface of the support member in the closed position of the cover and the second position of the support member.

A particularly advantageously construction embodying the above aspect of the present invention is obtained when the mounting means for the support member includes means for so pivotally mounting the support member on the confining member that the support member is displaced through substantially 90° in the second position relative to the first position. This pivotally mounting means advantageously includes a pivot that is so offset from the center of the support member that the contact surface and additional contact surface extend substantially along the same plane in the closed position of the cover and the second position of the support member.

The additional contact surface of the cover provides for additional guidance of the blade during the cutting operation when the support member is in the second position, as well as an additional safeguard against too deep a penetration of the cutting blade into the interior of the box. The positioning of the blade out of the region of the distancing surface permits the blade to cut along any box wall, particularly away from the edge regions of the box.

According to a further advantageous facet of the present invention, the confining member includes a channel which receives the support member in the first position, and an opening which opens into the channel to afford access to a portion of the support member when the latter is in the first position thereof. Then, the support member advantageously includes a notch on the aforementioned portion thereof, this notch providing a gripping surface to be engaged through the opening of the confining member to facilitate the movement of the support member between the first and second positions thereof. Then, there may further be provided means for visually indicating the direction of pivoting movement of the support member, which is situated on the aforementiond portion of the support member, to be visible through the opening in the first position of the support member.

Furthermore, instead of, or in addition to, the notch provided behind the opening of the confining member, the support member, which is predominantly, if not totally, received in the channel of the confining member in the first position thereof, has a leading portion that is provided with a notch, to provide a gripping surface usable for displacing the support member between its positions.

Last, but not least, the confining member is provided, within the channel thereof, with at least one rib which is in juxtaposition with the blade and operative for pressing the blade against the major surface of the support member at least in the first position of the latter. Hence, this rib or, preferably, two such ribs, securely hold the cutting blade within the recess when the support member is in its first position, so that the cutting blade is immovable relative to the support member in the first position. In the second position, the cover accomplishes the same purpose by pressing against the cutting blade in its closed position.

The novel features which are considered as characteristic of the invention are set forth in particular in the appended claims. The improved holding arrangement itself, however, both as to its construction and its mode of operation, together with additional features and advantages thereof, will be best understood upon perusal of the following detailed description of certain specific embodiments with reference to the accompanying drawings.

BRIEF DESCRIPTION OF THE DRAWINGS

FIG. 1 is a perspective view from below of an arrangement according to the present invention in its closed condition;

FIG. 2 is a sectional view taken on line 2—2 of FIG. 1;

FIG. 3 is a sectional view taken on line 3—3 of FIG. 1;

FIG. 4 is a sectional view taken on line 4—4 of FIG. 1;

FIG. 5 is a perspective view similar to that of FIG. 1 but with a hinged cover in its open position;

FIG. 6 is a perspective view from above of the arrangement according to the present invention as used for cutting a box open along its top edge in one cutting orientation;

FIG. 7 is a cross-sectional view taken on line 7—7 of FIG. 6, also as being used at the same region of the box;

FIG. 8 is a bottom plan view of the arrangement of FIG. 1, but with a support member carrying a cutting blade in its unconfined position;

FIG. 9 is a perspective view from below of the arrangement shown in FIG. 8 but with the cover in its closed position and as being used for cutting a box open remotely from the edge in another cutting orientation; and FIG. 10 is a sectional view taken on line 10—10 of FIG. 9, also as being used at the same remote region of the box.

DETAILED DESCRIPTION OF THE PREFERRED EMBODIMENTS

Referring now to the drawing in detail, and first to FIG. 1 thereof, it may be seen that the reference numeral 20 has been used to identify a cutting implement or tool according to the present invention. As shown, for instance, in FIG. 6, the tool 20 is particularly suited for use in cutting open a box or shipping carton 100. The box 100 includes, as seen in the position illustrated in FIG. 6, a top wall 101 and two side walls 102 and 103 which, in the closed condition of the box 100, meet with the top wall 101 at respective edges 104 and 105. The edge regions surrounding the edges 104 and 105 on the top wall 101, and on the respective side walls 102 and 103, respectively, are shown in FIG. 6 to be already partially cut by the cutting implement or tool 20.

As shown in FIGS. 1–4, the tool 20, which is constructed as a cutting or utility knife, includes a support member 21, a confining member 22, and a cover 23. A cutting blade 30 having a cutting edge 31 is mounted on the utility knife 20, being confined between the support member 21 and the confining member 22 in the illustrated first position of the support member 21 relative to the confining member 22.

As may be seen from the comparison of FIGS. 6 and 7, the box 100 is filled with a multitude of smaller boxes, cartons or packages 110, usually but not necessarily of the same size, which are to be removed from the interior of the shipping carton 100 at the desired destination, after the shipping carton 100 has been cut open by the cutting tool 20.

To avoid damage to the packages 110 during the cutting operation, it is necessary to assure that the cutting blade 30 travel as close to the top wall 101 of the box 100 as possible or feasible, and that it extend into the interior of the box 100 only to the extent necessary to obtain the cutting action at all regions of the box 100. For this reason, the confining member 22 is provided with a distancing portion 24 which is, during the cutting operation with the support member 21 in its first position, in contact with an external surface 107 of the top wall 101 of the box 100 adjacent to the respective edge or corner 104, the distancing portion 24 being arranged at a predetermined distance from the cutting blade 30 and thus determining how far from the edge 104 the cutting blade 30 will penetrate into the side wall 102. As shown in FIG. 7, the distance between the cutting blade 30 and the distancing portion 24 is substantially twice the thickness of the material of the box 100, to take into account the fact that, due to an overlap of flaps 108 of the box 100 at the top wall 101, the latter has a double thickness at least close to the edge 104, and it is desired to cut the box 100 as close below the top wall 101 as possible. It may also be seen in FIG. 7 that, even though the packages 110 are densely packed in the interior of the box 100, a small clearance still exists between the top wall of the respective package 110 and the top wall 101 of the box 100, and it is into this clearance that the cutting blade 30 extends. It will be appreciated that the more closely the distance matches the thickness of the top wall 101, the less likely it is that the package 110 will be damaged during the cutting operation; nevertheless, there are practical limits to how closely the cutting blade 30 can follow the inner surface of the top wall 101 without interfering therewith, so that the existence of the clearance is a necessary precondition for the cutting blade 30 to be able to penetrate into the box 100 and yet not to damage the respective package 110. The width of the clearance need only be a small fraction of an inch, and such a minimum clearance is always present at the top of the box 100, due to the settling of the packages 110 during transportation.

As mentioned before, it is also advisable to control the extent to which the blade 30 penetrates into the interior of the box or shipping carton 100 beyond the side wall 102 during the cutting operation. To this end, the support member 21 has a contact portion 25 having a contact surface which engages an external side surface 109 of the side wall 102 of the box 100 next to the respective edge 104 during the cutting operation, thus preventing the cutting blade 30 from penetrating deeper into the wall 102 than desired. The contact surface of the contact portion 25 of the support member 21 and the distancing surface of the distancing portion 24 of the confining member 22 are advantageously arranged at a right angle to one another and, as shown, the distancing portion 24 of the confining member 22 and the contact portion 25 of the support member 21 are arranged next to one another in the first position of the support member 21.

Turning now to FIGS. 2 to 4, it may be seen therein that the support member 21 has a major surface 26 at which the cutting blade 30 is arranged, preferably in a recess 27 configurated to hold the cutting blade 30 in a predetermined position relative to the support member 21. Such a position is shown in FIG. 8, for instance. In this cutting or active position of the cutting blade 30 on the support member 21, the cutting edge 31 of the cutting blade 30 faces forwardly as considered in the direction of movement of the cutting tool 20 during the cutting operation and extends at a predetermined acute angle with respect to the contact surface of the contact portion 25 of the support member 21.

As illustrated in FIGS. 8 and 10, the cutting blade 30 has a central opening or slot 32, and the support member 21 has a substantially pin-shaped projection 28 which is fittingly received in the slot 32 of the cutting blade 30 when the latter is mounted at the major surface 26 of the support member 21. Thus, the projection 28, and/or the surfaces bounding the recess 27 holds the cutting blade 30 in the desired active position on the support member 21. The support member 21 also has a finger 29 which confines the cutting blade 30 at one of the ends of the latter between itself and the major surface 26 of the support member 21. Due to the cooperation of the surfaces bounding the recess 27 and/or with the projection 28 and/or with the finger 29, the cutting blade 30 has a limited freedom of movement relative to the holding member 21 even when the latter is in its second position of FIG. 8 with the cover 23 in its open position, and maneuvering of the blade 30 is required when the blade 30 is to be removed from or mounted on the support member 21. However, the confining action of the confining member 22 in the first position of the support member 21 prevents this movement, so that the cutting blade 30 is securely held in the holding arrangement 23.

As may be seen, for instance, in FIG. 4, the confining member 22 has a generally C-shaped cross-section so as to embrace the support member 21; in other words, the confining member 22 bounds a channel 40 which receives the support member 21 and guides the same during its movement relative to the confining member 22 between the first and second position. The channel 40 communicates with the exterior of the confining member 22 longitudinally thereof through a slot 41 adjoining the contact portion 25. Of course, the cutting blade 30 extends through the slot 41 in the aforementioned first position of the support member 21.

As seen particularly in FIG. 2, the support member 21 has oppositely located cross-sectionally circular (see FIG. 8) pins or stub shafts 42 which are received in correspondingly configurated bores or recesses 43 provided in the confining member 22 within the channel 40. The two stub shafts 42 together constitute a pivot for the support member 21, about which the support member 21 is constrained to pivot relative to the confining member 22 into and out of the channel 40 through the slot 41, and thus between its first position of FIGS. 1 to 7, and its second position of FIGS. 8 to 10 in which it is displaced through substantially 90° relative to the first position thereof. As shown especially in FIG. 2, the confining member 22 is provided within the channel 40 with two raised ribs 44 which press against the cutting blade 30 and thus hold the same safely in the recess 27 in the first position of the support member 21.

As a comparison of FIGS. 2 to 4 will reveal, the cover 23 is mounted on the confining member 22 for pivoting relative thereto by means of pins or stub shafts 45 which are cross-sectionally circular and axially aligned with one another and which are received in correspondingly configurated recesses or bores 46 of the confining member 22, so that the cover 23 can pivot relative to the confining member between its closed position shown in FIGS. 1 to 4 and 9 to 10, and its open position illustrated in FIGS. 5 to 8. As shown in FIGS. 1, 5 and 8, the cover 23 is provided with a notch 47 through which, as shown in FIGS. 9 and 10 of the drawing, the support member 21 extends beyond the cover 23 and to the exterior of the combination of the confining member 22 with the cover 23 in the second position of the support member 2 and with the cover 23 closed. The notch or cutout 47 is delimited, on one of its sides, by a delimiting surface 48 which, as shown in FIG. 10, contacts the support member 21 in its second position and in the closed position of the cover 23, thus preventing the support member 21 from moving toward its first position until and unless the cover 23 is in its open position. Thus, the delimiting surface 48 of the cover 23 maintains the support member 21 in its second position, so long as the cover 23 is closed. Furthermore, in its closed position, the cover 23 presses against the cutting blade 30 at the opposite side away from the finger 29, so as to prevent the cutting blade 30 from moving out of the recess 27 and thus dissociating itself from the support member 21.

FIG. 10 shows that the cover 23 has a side wall 49 having an external guide or contact surface extending along a plane. Now, the pivot for the support member 21, which is constituted by the stub shafts or pins 42, is so situated relative to the confining member 22 and to the support member 21, and particularly so offset from the central axis of the latter, that the contact surface on the contact portion 25 of the support member 21 is situated in the aforementioned plane of the contact surface of the side wall 49 of the cover 23, so that these two contact surfaces together form a more extensive composite contact surface by means of which the tool 20 can be guided on any region of the box 100, as shown in FIG. 9, that is, even remotely from the edge 105 or any other edge of the box 100. As shown in FIG. 10, the blade 30 extends beyond the contact portion 25 of the support member 21 only to the extent sufficient to barely penetrate through the wall 102 of the box 100, so that this tool 20 is not able to cut a double thickness of the corrugated cardboard in a single operation. However, this slight disadvantage is more than outweighed by the fact that the cutting blade 31 will extend beyond the wall 102 or any other single-thickness wall of the box 100 during the cutting operation only to a minimum extent which is insufficient for penetrating into or otherwise damaging the contents of the box 100, even when the tool 20 is being used with the support member 21 in its second position as shown in FIGS. 9 and 10.

In FIG. 8, the cover 23 is in its open position in which it abuts against the confining member 22 and in which the entire blade 30 is accessible since the support member 21 is in its second position. Hence, the blade 30 can be removed from the support member 21 by maneuvering the same out of the recess 27, away from the pin 28, and from underneath the finger 29. To assist in this maneuvering, the support member 21 is provided, underneath one of the corners of the cutting blade 30, with a substantially fingernail-shaped recess 50, into which the user can insert his or her fingernail to engage the cutting blade 30 from below and thus to be able to lift the cutting blade 30 off the pin 28 and then further move the blade 30 past the pin 28, out of the recess 27, and from underneath the finger 29. Of course, the insertion of a new or a reoriented blade 30 onto the support member 21 follows the same procedure, but in the reversed order.

The cover 23 could be held in its closed position by pressure from the outside, such as that exerted by the fingers of a user during the cutting operation. However, this would be rather impractical, since the cover 23 could become displaced while the cutting tool 20 is situated in a pocket or the like, and the thus exposed cutting edge 31 of the cutting blade 30 could cause damage or even injury. To prevent this possibility, the cover 23 and the confining member 22 are provided with cooperating arresting means for arresting the cover in its closed position. Such arresting means is best shown in FIG. 8 and includes a tongue 51 on the cover 23 which engages in a correspondingly configurated and situated slot 52 of the confining member 22 in the closed position of the cover 23, and is clampingly retained therein. To be able to easily displace the cover 23 toward its open position, despite the retaining action of the arresting means 51, 52, the cover is provided with a fingernail ridge 53 against which the user can insert a part of his or her fingernail to get a secure grip on the cover 23 and be able to move the latter out of the closed position after overcoming the retaining action of the arresting means 51, 52.

As depicted in FIG. 2, the confining member 22 is provided, preferably behind the finger 29, with a bead 54 which engages the support member 21 in a frictional manner in and close to the first position of the support member 21. Hence, a certain amount of force is required when it is desired to move the support member out of its first position in the channel 40 of the confining member toward its second position. To be able to apply this necessary force to the support member 21, the confining member 22 is provided with an opening 55 shown particularly in FIGS. 1 to 3, through which a portion 56 of the support member 21 is visible and accessible. This portion 56 is provided with a fingernail notch 57 which presents a gripping surface which can be engaged by the user in a secure manner and used to transmit such forces to the support member 21 as to displace the same in direction toward its second position. The portion 56 of the support member 21 also forms a relief 58 of an arrow pointing in the direction of displacement of the support member 21 toward its second position. This provides a visual indication of the suggested direction of movement of the support member 21, which may not be readily apparent from merely observing the tool 20 with the cover 23 closed and the support member 21 in its first position.

FIG. 8 further shows that the support member 21 may be provided with an additional fingernail notch 59 on its portion 60 that may be accessed, or is close to being accessed, in the first position of the support member 21. As shown, this portion 60, or the notch 59, are received within the confines of the confining member 22 when the support member 21 is in its first position. However, as soon as the support member 21 is ever so slightly displaced out of its first position towards its second position, such as by means of the fingernail notch 57, the notch 59 will become accessible and can be engaged by the fingernail of the user to continue and complete the displacement of the support member 21 towards its second position.

In FIG. 7 especially, the cover 23 is shown in its open position in which it exposes the cutting blade 30 for the performance of the cutting operation close to the edge 104 of the box 100. In this operative position, an engagement surface of an engagement portion 61 (see FIG. 5) of the cover 23 contacts the surface 109 of the box 100 at the opposite side of the cutting blade 30 from the contact portion 25, thus providing for additional guidance of the tool 20 on the box 100, as well as for an additional safeguide against too deep a penetration of the cutting blade 30 into the interior of the box. The additional contact area provided by the engagement surface of the cover 23 tends to insure that the tool will be properly positioned at the edge region of the box 100. The blade 30 will thus be positively guided throughout the cutting stroke, thereby resulting in a clean, non-jagged cutting line. To maintain the cover 23 in this open position against any further pivoting in the counterclockwise direction, the confining member 22 has an abutment portion 63 (see FIG. 5) against which the cover 23 abuts in the open position. The orientation of the tool 20 relative to the edge region of the box 100 which is shown in FIGS. 6 and 7 constitutes a first cutting orientation.

Similarly, as best shown in FIGS. 9 and 10, the tool 20 has been converted to another cutting orientation which is specially suited to cut the box away from its edge regions, e.g. along any cutting line having any desired contour. The additional contact area provided by the engagement of the contact surface of the side wall 49 of the cover 23, together with the co-planar contact surface 25 of the support member 21, provides for additional guidance of the tool 20 on the box wall 102, as well as for an additional safeguard against too deep a penetration of the cutting blade into the interior of the box, and also tends to insure that the tool will be properly and reliably positioned at the box wall 102 so that the blade 30 will thus be positively guided throughout the cutting stroke, thereby resulting in a clean, non-jagged cutting line of any desired contour.

To obtain the co-planar characteristic of the contact surface 25 with the contact surface of the cover side wall 49, a cutout 62 is formed in the leading portion of the support member 21 and, upon closing of the cover 23, the side wall 49 is received in the cutout 62 such that the outer contact surface of the cover side wall 49 is essentially co-planar with the plane of the contact surface 25.

After the tool is used in either one or both of the aforementioned cutting orientations, the cover 23 may be initially displaced to its open position; the support member 21 may then be moved to its first position; and the cover 23 may thereupon be displaced back to its closed position, thereby covering the blade cutting edge and defining a safety orientation therefor.

It will be understood that each of the elements described above, or two or more together, may also find useful application in other types of arrangements differing from the type described above.

While the invention has been illustrated and described as embodied in a cutting implement for opening corrugated cardboard shipping cartons at their edge regions or remotely therefrom, it is not intended to be limited to the detail shown, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

I claim:

1. An arrangement for holding a cutting blade having at least one cutting edge, particularly for use as a utility knife for opening filled boxes, especially of corrugated board which include associated adjacent box surfaces that meet at respective edges, comprising:

a support member for the blade having a major surface and a contact surface substantially normal to said major surface and operative for contacting one of the associated adjacent surfaces of the box during the cutting operation;

means for dismountably holding the blade on said major surface in an active position in which the cutting edge of the blade is at least partially situated beyond said contact surface of said holding member to penetrate into the respective box next to said contact surface during the cutting operation;

a confining member having a distancing surface substantially parallel to and spaced a predetermined distance from the blade;

means for mounting said support member on said confining member for movement relative thereto between a first position in which said confining member confines the blade between itself and said major surface and said distancing surface extends beyond said contact surface to engage the other of the associated adjacent surfaces of the box during the cutting operation and thus to keep the cutting blade at said predetermined distance from the other adjacent surface, and a second position in which said support member extends beyond said distancing surface, and the blade is accessible; and a cover for the cutting edge of the blade mounted on said confining member for displacement between an open position in which the cutting edge is exposed both in said first and second position of said support member and a closed position in which the cutting edge is covered when said support member is in said first position, and exposed beyond said cover when said support member is in said second position thereof, said cover including means for confining said blade between itself and said major surface, and means for keeping said support member in said second position thereof, in said closed position of said cover.

2. The holding arrangement as defined in claim 1, wherein said cover has an engagement surface; and wherein said confining member includes abutment means arranged in the path of displacement of said cover for positioning said engagement surface of said cover in substantially the same plane as said contact surface of said support member in said open position of said cover, said engagement surface contacting said one associated adjacent surface of the box together with said contact surface of said support member to thereby provide for additional guidance of the blade during the cutting operation when said support member is in said first position thereof.

3. The holding arrangement as defined in claim 1, wherein said holding means is so arranged relative to said major surface that the cutting edge of the blade extends at an acute angle relative to said contact surface of said support member in said active position thereof.

4. The holding arrangement as defined in claim 1, wherein said holding means includes means for defining a recess for accommodating a portion of the blade at said major surface.

5. The holding arrangement as defined in claim 1 for use with a cutting blade having at least one opening therein, wherein said holding means includes at least one projection on said support member at said major surface thereof extending into the opening of the blade when the latter is juxtaposed with said major surface.

6. The holding arrangement as defined in claim 1, wherein said confining member bounds a channel which fittingly receives said support member in said first position.

7. The holding arrangement as defined in claim 6; and further comprising means for retaining said members in said first position thereof relative to one another.

8. The holding arrangement as defined in claim 7, wherein said retaining means includes at least one elastic projection on one of said members which engages the other of said members in said first position of said support member.

9. The holding arrangement as defined in claim 1, wherein said predetermined distance amounts substantially to twice the thickness of the material of the box.

10. The holding arrangement as defined in claim 1, wherein said holding means so holds the blade in said one position thereof that the cutting edge of the blade extends beyond the contact surface to an extent amounting at least to the thickness of the material of the box.

11. The holding arrangement as defined in claim 1, and further comprising means for connecting said cover to said confining member for movement between said closed and open positions.

12. The holding arrangement as defined in claim 11, wherein said connecting means includes at least one hinge which mounts said cover on said confining member for pivoting between said positions.

13. The holding arrangement as defined in claim 12, wherein said cover has a cutout for passage of said support member therethrough in said closed position of said cover and said second position of said support member, said cutout being delimited by at least one delimiting surface constituting said keeping means.

14. The holding arrangement as defined in claim 13, wherein said cover has an additional contact surface aligned with and constituting an extension of said contact surface of said support member in said closed position of said cover and said second position of said support member.

15. The holding arrangement as defined in claim 14, wherein said mounting means includes means for so pivotally mounting said support member on said confining member that said support member is displaced through substantially 90° in said second position relative to said first position.

16. The holding arrangement as defined in claim 15, wherein said pivotally mounting means includes a pivot that is so offset from the center of said support member that said contact surface and additional contact surface extend substantially along the same plane in said closed position of said cover and said second position of said support member.

17. The holding arrangement as defined in claim 1, and further comprising means for releasably arresting said cover in said closed position thereof.

18. The holding arrangement as defined in claim 17, wherein said arresting means includes at least one projection on one, and at least one recess in the other, of said confining member and cover, said recess receiving said projection in said closed position of said cover.

19. The holding arrangement as defined in claim 1, wherein said mounting means includes means for mounting said support member for pivoting movement relative to said confining member.

20. The holding arrangement as defined in claim 19, wherein said confining member includes a channel which receives said support member in said first position, and an opening which opens into said channel to afford access to a portion of said support member when the latter is in said first position thereof.

21. The holding arrangement as defined in claim 20, wherein said support member includes a notch on said portion thereof for providing a gripping surface to be engaged through said opening to facilitate the movement of said support member between said first and second positions thereof.

22. The holding arrangement as defined in claim 20, and further comprising means for visually indicating the direction of pivoting movement of said support member, situated on said portion of said support member.

23. The holding arrangement as defined in claim 19, wherein said confining member includes a channel which receives said support member in said first position; and wherein said support member has a leading portion as considered in the direction from said first position to said second position, and having a notch therein for providing a gripping surface accessible externally of said confining member to facilitate the movement of said support member between said first and second positions thereof.

24. The holding arrangement as defined in claim 1, wherein said confining member includes a channel which receives said support member in said first position, and at least one rib within said channel in juxtaposition with the blade and operative for pressing the blade against said major surface at least in said first position of said support member.

25. An arrangement for holding a cutting blade having a cutting edge in either one of two cutting orientations relative to a box having box surfaces that meet at edge regions, comprising:

a blade support member having a contact surface operative for contacting one box surface during the cutting operation in either cutting orientation of the arrangement;

means for holding the blade on said support member in an active position in which the blade cutting edge is at least partially situated beyond said contact surface to penetrate into said one box surface during the cutting operation in either cutting orientation of the arrangement;

a confining member having a distancing surface substantially parallel to and spaced a predetermined distance from said blade, and operative for contacting another box surface adjacent said one box surface at the respective edge region where said box surfaces meet during the cutting operation in one of said cutting orientations;

means for mounting said support member on said confining member for movement relative thereto between a first position in which said contact surface is substantially normal to said distancing surface and in which the blade is situated at said predetermined distance from said distancing surface in said one cutting orientation, and a second position in which said support member extends beyond said distancing surface and in which the blade is situated out of the region of the latter during the cutting operation in the other of said cutting orientations;

a cover for the blade cutting edge; and means for mounting said cover on one of said members for displacement between an open position in which the blade cutting edge is exposed in said one cutting orientation, and a closed position in which the blade cutting edge is exposed beyond said cover when said support member is in said second position in said other cutting orientation and in which the blade cutting edge is concealed within said cover when said support member is in said first position to thereby define a safety orientation for the arrangement.

26. The holding arrangement as defined in claim 25, wherein said cover in its open position has an engagement surface which lies in substantially the same plane as said contact surface of said support member to thereby provide for additional guidance of the blade during the cutting operation in said one cutting orientation.

27. The holding arrangement as defined in claim 25, wherein said cover in its closed position has an engagement surface which lies in substantially the same plane as said contact surface of said support member to thereby provide for additional guidance of the blade during the cutting operation in said other cutting orientation.

* * * * *